United States Patent [19]

Bowers et al.

[11] Patent Number: 4,998,969

[45] Date of Patent: Mar. 12, 1991

[54] ENGINE MAINTENANCE FLUID INTRODUCTION SYSTEM

[75] Inventors: William W. Bowers, Waukegan; M. Jeremy Lieb, Northbrook, both of Ill.; Robert J. Shockey, Miami, Fla.

[73] Assignee: Outboard Marine Corporation, Waukegan, Ill.

[21] Appl. No.: 523,328

[22] Filed: May 14, 1990

[51] Int. Cl.[5] ..... F02M 1/16

[52] U.S. Cl. ..... 123/187.5 R; 123/1 A; 123/198 A

[58] Field of Search ..... 123/1 A, 198 A, 196 M, 123/187.5 R, 180 R

[56] References Cited

U.S. PATENT DOCUMENTS

| | | | |
|---|---|---|---|
| 2,194,007 | 3/1940 | Clementson | 123/196 M |
| 2,366,073 | 12/1944 | Valerie | 123/198 A |
| 3,671,148 | 6/1972 | Reeve | 417/295 |
| 3,827,417 | 8/1974 | Morita | 123/127 |
| 4,284,040 | 8/1981 | Baltz | 123/187.5 R |
| 4,321,314 | 1/1982 | McChesney | 429/50 |
| 4,373,479 | 2/1983 | Billingsley | 123/187.5 R |
| 4,807,578 | 2/1989 | Adams et al. | 123/198 A |

*Primary Examiner*—E. Rollins Cross

*Attorney, Agent, or Firm*—Michael, Best & Friedrich

[57] ABSTRACT

Disclosed herein is an internal combustion engine comprising a cylinder defining a combustion chamber, a primer fuel conduit communicating with the combustion chamber for supplying a primer fuel to the combustion chamber, and a valved supply conduit for introducing an engine maintenance fluid into the primer fuel conduit.

10 Claims, 1 Drawing Sheet

ENGINE MAINTENANCE FLUID INTRODUCTION SYSTEM

FIELD OF THE INVENTION

The invention relates to internal combustion engines and to arrangements for introducing engine maintenance fluids to the interior of such engines. Such maintenance fluids can include, for example, fogging oil and engine tuning or cleaning fluids.

The invention also more particularly relates to fogging systems for internal combustion engines, i.e., to arrangements and methods for coating the interior surface of an internal combustion engine with a lubricant or fogging oil to protect against corrosion in the event it is expected that the engine will not be in use for some time. For example, fogging oil is commonly applied to the engine of an outboard motor prior to winter storage.

REFERENCE TO PRIOR ART

In the past, fogging has been achieved by techniques including spraying atomized oil into the engine through the intake openings in an air silencer, or by removing the air silencer and spraying fogging oil directly into the carburetor. When fogging in this manner, engine speed is raised to prevent engine stalling or fouling and overspraying with messy results often occurs.

Attention is directed to the following United States patents:

| | | |
|---|---|---|
| 3,671,148 | Reeve | June 20, 1972 |
| 3,827,417 | Morita | August 6, 1974 |
| 4,284,040 | Baltz | August 18, 1981 |
| 4,321,314 | McChesney | January 28, 1982 |
| 4,373,479 | Billingsley | February 15, 1983 |
| 4,807,578 | Adams, et al. | February 28, 1989 |

SUMMARY OF THE INVENTION

The invention provides an internal combustion engine comprising a cylinder defining a combustion chamber, and means including a primer fuel conduit communicating with the combustion chamber for supplying a primer fuel to the combustion chamber, and means for introducing an engine maintenance fluid into the conduit.

The invention also provides an internal combustion engine comprising a cylinder defining a combustion chamber, and means for supplying a primer fuel to the combustion chamber and including a housing having therein a primer fuel conduit communicating with the combustion chamber, and means for introducing an engine maintenance fluid into the conduit and including a branch conduit located in the housing and communicating with the primer fuel conduit and including a valve operable to permit flow of engine maintenance fluid under pressure into the conduit and to prevent flow from the conduit and further including a first fitting, and a second fitting communicable with a source of engine maintenance fluid under pressure and disconnectably assembleable with the first fitting and including means for opening the valve in response to assembly of the first and second fittings.

The invention also provides an internal combustion engine comprising a cylinder defining a combustion chamber, and means for supplying a primer fuel to the combustion chamber, and including a housing having therein a primer fuel conduit, and a trigger mounted on the housing and operable to supply primer fuel to the conduit, and means for introducing an engine maintenance fluid into the conduit and including a branch conduit located in the trigger and communicating with the primer fuel conduit and including a valve operable to permit flow of engine maintenance fluid under pressure into the conduit and to prevent flow from the conduit and further including a first fitting, and a second fitting communicable with a source of engine maintenance fluid under pressure and disconnectably assembleable with the first fitting and including means for opening the valve in response to assembly of the first and second fittings.

Other features and advantages of the invention will become apparent to those skilled in the art upon review of the following detailed description, claims, and drawings.

THE DRAWINGS

Figure 1:
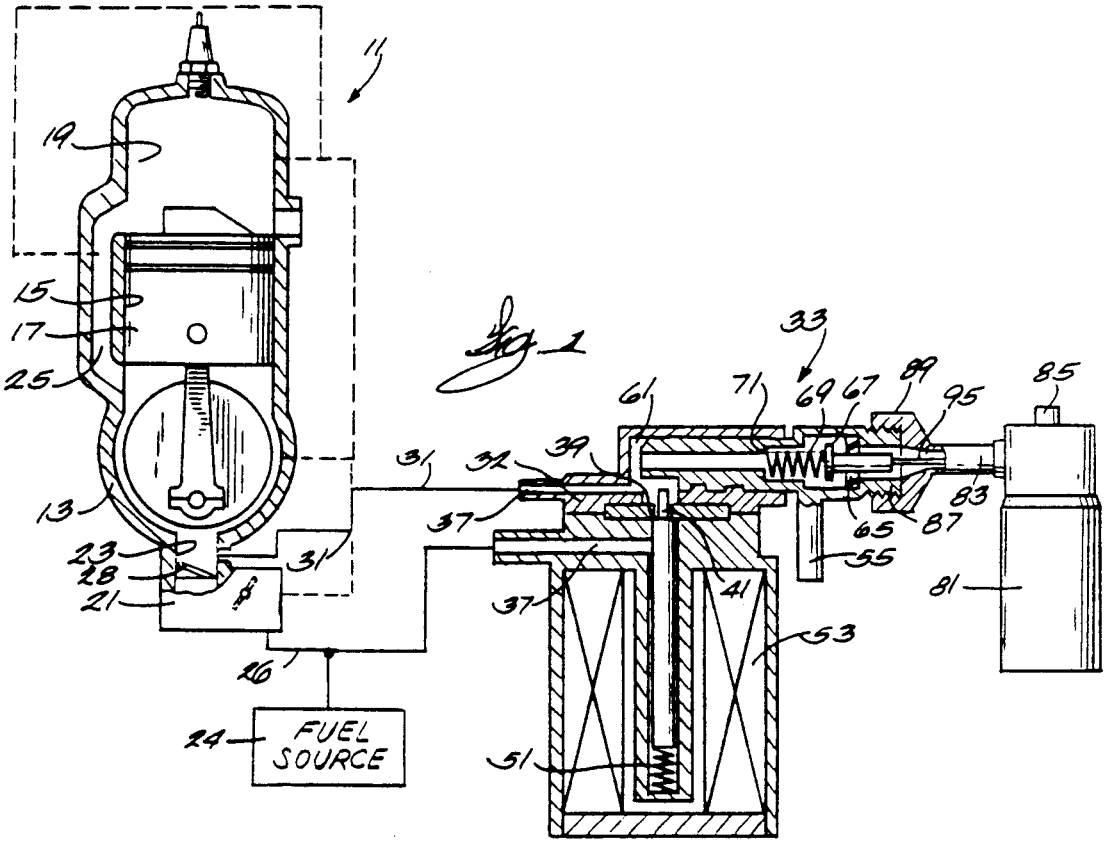
FIG. 1 is a schematic view, partially in section of one embodiment of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is an engine 11 which can be a four-stroke engine, which, in the drawings, is a two-stroke engine, and which includes a crankcase 13, a cylinder 15 extending from the crankcase 13, a piston 17 located in the cylinder 15 and defining a variable volume combustion chamber 19 in the cylinder 15, and means communicating with the combustion chamber for supplying fuel to the combustion chamber 19.

While other fuel supplying means can be employed, such as direct fuel injection, in the illustrated construction, such means comprises the crankcase 13, and a carburetor 21 which is connected to a suitable fuel source 24 through a conduit 26 and which includes an induction passage 23 communicable through an intake manifold (not shown), and through one or more conventional one-way reed valves 28, with the crankcase 13. The illustrated fuel supply means also includes one or more transfer passages 25 which extend between the crankcase 13 and the combustion chamber 19 and which open and close in response to piston reciprocation.

The engine 11 also includes means connected to one of the combustion chamber 19 and the fuel supply means for supplying primer fuel to the combustion chamber 19. While other constructions can be employed, in the disclosed construction, such primer fuel supply means includes a primer fuel conduit 31 connected to one of the combustion chamber 19 and the fuel supply means i.e., in the disclosed construction, connected to the intake manifold or crankcase 23 downstream of the usual reed valve 28 between the carburetor and the crankcase. Alternatively, the primer fuel conduit 32 can be connected (as shown in dotted lines)

directly to the combustion chamber 19, or to the induction passage 23 of the carburetor 21, or to the transfer passage 25, both of which communicate with the combustion chamber 19.

The primer fuel supply means can also include a primer fuel supply valve 33 which includes a housing 32, which communicates with the primer fuel conduit 31 and with the fuel source 24, and which is operable between an open position to supply primer fuel to the primer fuel conduit 31 and hence to the combustion chamber 19 and a closed position preventing such supply. While other constructions can be employed, in the disclosed construction, the primer fuel supply valve 33 includes a conduit or conduit section 37 located interiorly of the housing 32 and communicating with the fuel source 24 and with the primer fuel conduit 31 and including a valve seat 39, and a valve member 41 moveable relative to the valve seat 39 between open and closed positions.

Any suitable means can be employed to displace the valve member 41 between its open and closed positions. In the illustrated construction, such means includes means in the form of a spring 51 for biasing the valve member 41 to the closed position, and a solenoid 53 operable against the action of the spring 51, when electrically actuated, to displace the valve member 41 to the open position, and a manually operated movable member or lever or trigger 55 mounted on the housing 32 and operably engageable, by suitable means (not shown), with the valve member 41 to displace the valve member 41 to the open position in response to manipulation of the manually operated member 55 and against the action of the spring 51.

Means are also provided for selectively supplying engine maintenance fluid, such as engine tuner and fogging oil, to the means for supplying primer fuel to the engine 11. While the description hereinafter refers to fogging oil, it should be remembered that the invention is applicable to any engine maintenance fluid. While other constructions can be employed, in the arrangement shown in FIG. 1, the engine maintenance fluid supply or fogging oil supply means includes a branch conduit 61 communicating with the primer fuel conduit 31 and valve means located in the branch conduit 61 and moveable between an open position and a closed position.

While other constructions can be employed, in the disclosed construction, such valve means includes a valve seat 65 formed in the branch conduit 61 and a valve member 67 moveable relative to the valve seat 65. The valve means also includes means for biasing the valve member 67 to the closed position. While other arrangements can be employed, in the disclosed construction, such means comprises a spring 69 acting between the valve member 67 and a shoulder 71 in the branch conduit 61.

Means are also provided for opening the valve means and for connecting the branch conduit 61 to a suitable source of fogging oil, or other engine maintenance fluid, under pressure. While other arrangements can be employed, the disclosed construction contemplates a can or container 81 which contains fogging oil under pressure, together with a discharge conduit 83 which is preferably fabricated of a flexible tubular material and which extends from the can 81, and a suitable valve means 85 located on the can 81 and operable manually for permitting and preventing flow of the fogging oil from the can 81 into the fogging oil discharge conduit 83.

The means for communicating the branch conduit 61 with the fogging oil source also includes fitting means for connecting the fogging oil discharge conduit 83 to the branch conduit 61. While other constructions can be employed, in the disclosed construction, such fitting means comprises an exteriorly threaded area or fitting 87 adjacent the end of one of the branch conduit 61 and the fogging oil discharge conduit 83, and an interiorly threaded fitting or nipple 89 on the adjacent end of the other of the branch conduit 61 and the fogging oil discharge conduit 83, which nipple 89 is threadedly engageable with the threaded area 87 to effect a pressure-tight connection between the branch conduit 61 and fogging oil discharge conduit 83.

The means for opening the valve means includes a fixed pin 95 which is suitably supported at the end of the fogging oil discharge conduit 83 and which, incident to connection of the branch conduit 61 and the fogging oil discharge conduit 83, projects into the branch conduit 61 and displaces the valve member 67 from the valve seat 65 against the action of the spring 69.

Figure 2:
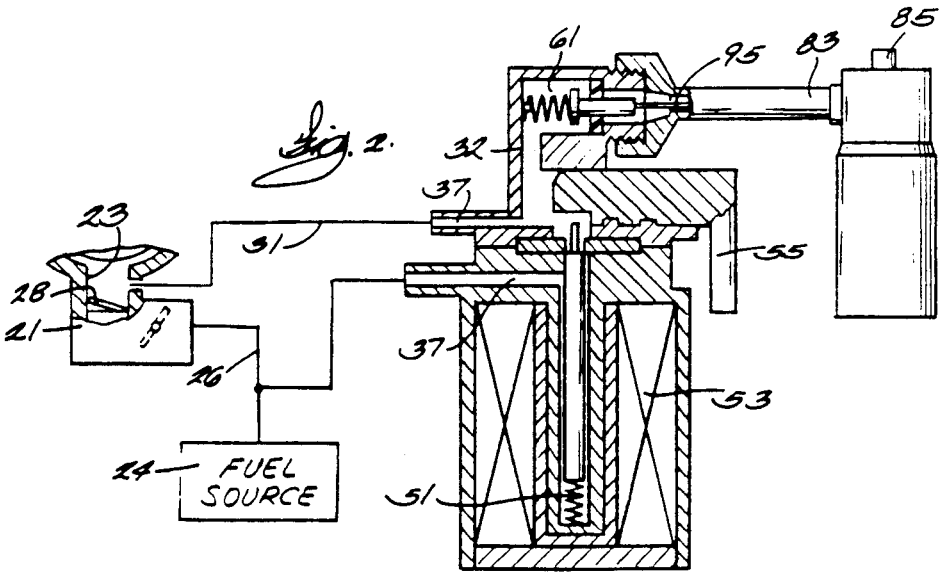
FIG. 2 is a schematic view, partially in section, of another embodiment of the invention.

In the FIG. 1 construction, the branch conduit 61 is integrated into the manual operated member or trigger 55 of the primer fuel supply valve, and in the construction shown in FIG. 2, the branch conduit 61 is integrated into the housing 32. Other arrangements could also be employed.

Thus, when the fitting means is connected, the valve means is opened, and operator actuated manipulation to open the valve means 85 in the can 81 containing the pressurized fogging oil will serve to discharge fogging oil through the fogging oil discharge conduit 83, into the branch conduit 61 and past the valve seat 65, through the primer fuel interior conduit section 37, through the primer fuel conduit 31, to the crankcase 13 and combustion chamber 19 of the engine 11. Because the path from the container or can 81 to the engine 11 is sealed from the atmosphere, the fogging oil can be readily introduced into the engine when the engine is running, and the operation of the engine is only minimally affected by insertion of the fogging oil, or other maintenance fluid. Thus, fogging oil can be readily and effectively applied to the interior of the engine 11 by connecting the fitting means and by manually opening the valve 85 on the fogging oil can 81.

Use of the disclosed system facilitates distribution of the fogging oil evenly to all cylinders of a multi-cylinder engine by reason of the injection into the primer fuel system. In addition, the disclosed system allows engine operation at a relatively low speed, does not require any tools, and does not involve messy overspray.

Various of the features of the invention are set forth in the following claims.

We claim:

1. An internal combustion engine comprising a cylinder defining a combustion chamber, and means including a primer fuel conduit communicating with said combustion chamber for supplying a primer fuel to said combustion chamber, and means for introducing an engine maintenance fluid into said conduit.

2. An internal combustion engine in accordance with claim 1 wherein said means for supplying a primer fuel to said conduit includes a housing and a trigger mounted on said housing and operable to supply primer fuel to said conduit.

3. An internal combustion engine in accordance with claim 1 wherein said means for introducing an engine maintenance fluid includes a valve communicable with said primer fuel conduit and with a source of engine maintenance fluid under pressure and operable to permit flow of engine maintenance fluid under pressure into said conduit and to prevent flow from said conduit.

4. An internal combustion engine in accordance with claim 3 wherein said means for supplying a primer fuel to said conduit includes a housing and a trigger mounted on said housing.

5. An internal combustion engine in accordance with claim 4 wherein said valve is located in said housing.

6. An internal combustion engine in accordance with claim 4 wherein said valve is located in said trigger.

7. An internal combustion engine in accordance with claim 3 wherein said means for introducing an engine maintenance fluid comprises a branch conduit communicating with said primer fuel conduit and including said valve.

8. An internal combustion engine in accordance with claim 7 wherein said means for introducing an engine maintenance fluid also includes a first fitting communicating with said branch conduit and a second fitting disconnectably assembleable with said first fitting and including means for opening said valve in response to assembly of said first and second fittings.

9. An internal combustion engine comprising a cylinder defining a combustion chamber, and means for supplying a primer fuel to said combustion chamber and including a housing having therein a primer fuel conduit communicating with said said combustion chamber, and means for introducing an engine maintenance fluid into said conduit and including a branch conduit located in said housing and communicating with said primer fuel conduit and including a valve operable to permit flow of engine maintenance fluid under pressure into said conduit and to prevent flow from said conduit and further including a first fitting, and a second fitting communicable with a source of engine maintenance fluid under pressure and disconnectably assembleable with said first fitting and including means for opening said valve in response to assembly of said first and second fittings.

10. An internal combustion engine comprising a cylinder defining a combustion chamber, and means for supplying a primer fuel to said combustion chamber and including a housing having therein a primer fuel conduit, and a trigger mounted on said housing and operable to supply primer fuel to said conduit, and means for introducing an engine maintenance fluid into said conduit and including a branch conduit located in said trigger and communicating with said primer fuel conduit and including a valve operable to permit flow of engine maintenance fluid under pressure into said conduit and to prevent flow from said conduit and further including a first fitting, and a second fitting communicable with a source of engine maintenance fluid under pressure and disconnectably assembleable with said first fitting and including means for opening said valve in response to assembly of said first and second fittings.

* * * * *